United States Patent [19]

Rodrigues

[11] 4,044,326

[45] Aug. 23, 1977

[54] HERMETIC SEAL BETWEEN TELESCOPING CYLINDERS OF A FUSE HOUSING

[75] Inventor: David A. Rodrigues, Pittsfield, Mass.

[73] Assignee: General Electric Company

[21] Appl. No.: 621,017

[22] Filed: Oct. 9, 1975

[51] Int. Cl.[2] ..... H01H 85/14

[52] U.S. Cl. ..... 337/248; 337/414

[58] Field of Search ..... 337/158, 159, 186, 187, 337/248, 273, 276, 414, 415

[56] References Cited

U.S. PATENT DOCUMENTS

| | | | |
|---|---|---|---|
| 3,157,766 | 11/1964 | Edsall | 337/248 |
| 3,250,879 | 5/1966 | Jacobs, Jr. | 337/248 |
| 3,342,962 | 9/1967 | Kozacka | 337/276 X |
| 3,662,309 | 5/1972 | Harmon | 337/248 X |
| 3,863,187 | 1/1975 | Mahieu et al. | 337/159 X |

*Primary Examiner*—George Harris
*Attorney, Agent, or Firm*—Francis X. Doyle

[57] ABSTRACT

The end caps of an electric current limiting fuse are telescopingly fitted inside the end portion of a housing tube and sealed to the inside wall in at least two spaced-apart locations to isolate an annular space between the outside cylindrical cap surface and the inside cylindrical housing tube surface. A settable adhesive fills the annular space to tightly bond the cap to the housing and to form a strong hermetic seal.

Also disclosed is a method of making the seal described above, including the steps of assembling in telescoping relationship two cylindrical workpieces, providing at least two seals between the pieces to define an annular space between them, injecting a settable adhesive into the annular recess through an injection port in one of the cylinders while bleeding air out through a bleed aperture, and baking to set the adhesive.

6 Claims, 3 Drawing Figures

HERMETIC SEAL BETWEEN TELESCOPING CYLINDERS OF A FUSE HOUSING

BACKGROUND OF THE INVENTION

The present invention relates generally to means for rigidly and hermetically and rigidly sealing together two telescopingly assembled workpieces. It relates particularly to, but is not limited to, such means for establishing a seal between a metal end cap and the end portion of an insulating tubular electrical fuse casing into which the cap is inserted.

Certain electrical devices are especially sensitive to their surroundings and are therefore enclosed in a hermetically sealed housing. For such devices which are then exposed to adverse conditions, such as long term weathering or immersion in hot transformer oil, it is important that the seals of the housing reliably maintain their integrity despite being subjected to numerous temperature cycles. For products which are manufactured in large numbers, and which include seals between parts having significantly different thermal expansion characteristics, such seals are difficult to achieve without requiring costly greater demensional precision of parts.

One electrical device which requires such a rigid hermetic seal, and which is manufactured in large numbers, is an electric current-limiting fuse. Current limiting fuses are used to interrupt large fault currents at high voltages in a controlled manner without in so doing generating damaging voltage transients in the electrical system which they protect.

Typically, a current-limiting fuse has an elongated, tubular insulating housing tube which is closed at both ends by metal terminal end caps. Supported between the end caps, and extending the length of the fuse, is a support core on which are helically wound one or more fusible wire or ribbon elements connected between the end caps. The remaining space in the interior of the housing is filled with a tightly-packed particulate filler of arc-quenching material, such as quartz sand.

When a fault current passes through the fuse element, the element melts, and one or more arcs are generated between the free ends of the severed element. The arcs interact in a controlled manner with the filler, so that as they become elongated with the progressive burning back of the element, their resistance increases greatly until the current is so small that the arcs can no longer be sustained and are finally extinguished to open the circuit.

Contaminants such as moisture or oil inside the fuse can result in its failure either during, or subsequent to its operation by, for example, providing a parallel conductive path to the fusible element or greatly increasing the pressure shock wave due to the release of energy from the vaporization of water or oil. Yet, such fuses are commonly located openly outdoors or immersed in the oil of a transformer. Therefore, the integrity of the seal between the housing tube and the end caps is a critical factor in preventing failure of the fuse.

One present type of seal for fuses is made by interposing a resilient gasket between the housing tube and a metal end cap which fits over the end portion of the tube and then crimping the cap wall tightly against the gasket to form a compression seal. A disadvantage of this approach is that it does not permit the use of end caps which fit inside the tube to make a constant diameter housing. A constant diameter housing is better suited for bayonnet fuse holders and also makes better use of available space inside the fuse ends. Another disadvantage is that the resulting seal is not rigid, the cap being held in place primarily by the friction between the cap to gasket and gasket to tube surfaces. The pressure of gases generated in the fuse when it operates may be sufficient to overcome the frictional forces and push the cap off the end. Still another and more serious disadvantage of such a compression seal is that when the fuse is immersed in transformer oil, the oil can seep under the gasket along minute surface imperfections in the tube, which is typically a glass fiber-reinforced epoxy resin composition.

Another present type of seal is one in which the caps are rigidly attached to the tube by mechanical means, such as pins through the tube and cap, and then the entire end of the fuse jacketed in epoxy resin. It has been found, however, that thermal cycling can result in cracking of the jacket which breaks the seal.

Still another type of seal presently used for fuses is one in which the entire body of the assembled fuse, except the terminals, is jacketed with an epoxy material especially formulated to have a coefficient of thermal expansion closely matching that of the housing tube. Fuses with such a seal are described, for example, in U.S. Pat. No. 3,723,930 issued 27 Mar. 1973 to R. E. Koch and assigned to the same assignee as are the rights to the present invention. While jacketed fuses of this type operate satisfactorily, their manufacturing cost is relatively high due to special procedures required for preparing and applying the epoxy jacket. Lowering the cost of the procedures by automation however, would require too great an investment to be justified by the extent of the total product market.

SUMMARY OF THE INVENTION

In accordance with the present invention a rigid hermetic seal between two telescoping members is made by injecting a settable adhesive into an annular space between the members.

The adhesive rigidly and hermetically seals the members together. The injection process assures effective wetting of the surface of the members by the adhesive to form a bond strong enough to reliably withstand temperature cycling of members with significantly different coefficients of thermal expansion.

DESCRIPTION OF THE PREFERRED EMBODIMENT

Figure 1:
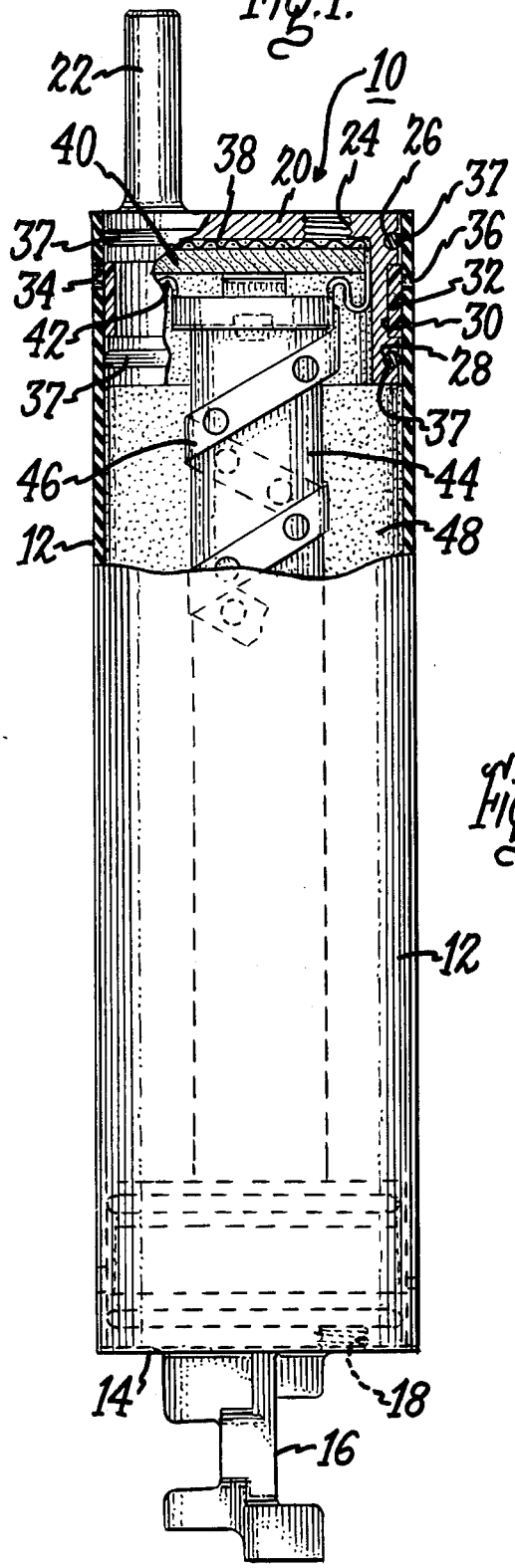
FIG. 1 is a partially sectioned side view of a fuse in accordance with the preferred embodiment of the invention, showing an end cap sealed to a housing tube.
Figure 2:
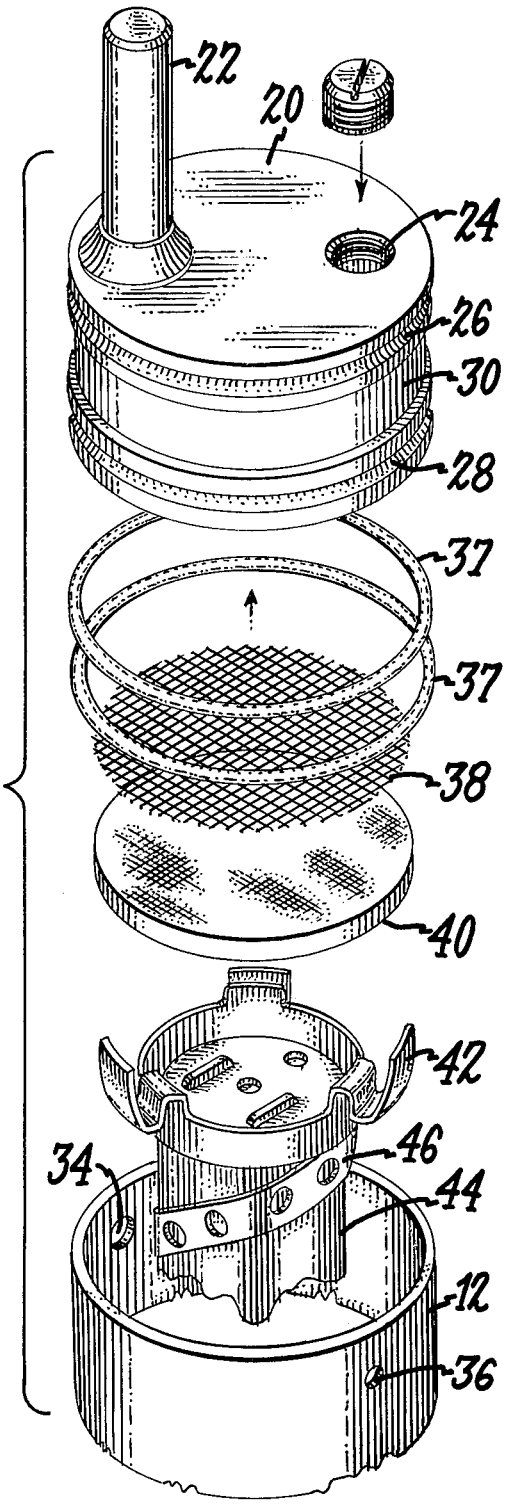
FIG. 2 is an exploded perspective view of various parts of the end cap of FIG. 1.

A preferred embodiment of the invention is the electric current-limiting fuse shown in FIGS. 1 and 2 of the drawings. The fuse 10 is encased in a glass-epoxy housing tube 12 closed at one end by a cast bronze end cap 14, which is provided with a terminal base 16 and a fill port 18. The other end of the fuse 10 is closed by a cast bronze end cap 20, which is provided with a connecting stud 22 and an outlet port 24.

The end caps 14, 20 are sealed to the inside of the tube by an annular, settable adhesive seal structure shown in FIG. 1 only for the end cap 20. The outer perimeter of the end cap 20 has formed in it an outer O-ring groove 26 and an inner 0-ring groove 28. Between the grooves 26, 28 is an annular recess 30, which is filled with a thermosetting one-part structural epoxy adhesive composition 32 to bond the cap 20 to the inside surface of the fuse tube 12.

Disposed on the inside surface of the end cap 20 is a woven aluminum wire support screen 38 on which there rests a ceramic fiber filter pad 40. A copper element connector 42 is soldered to the inside perimeter of the end cap 20. Attached to the element connector 42 is one end of a ceramic support core 44, about which there is helically wound a perforated silver fusible ribbon element 46. The entire interior of the fuse 10 is filled with 40-mesh purified silica sand 48 bound together into a self-supporting matrix with colloidal silica.

The adhesive 32 is filled into the annular recess 30 by a novel process. After the end cap 20 is inserted into the end of the tube 12, the adhesive 32 is injected into the recess 30 through an injection aperture 34 about 3.1 mm (millimeters) in diameter in the tube 12 at a pressure of about 65 atmospheres, while the displaced air escapes through a bleed aperture 36 about 0.016 mm in diameter on the opposite side of the tube 12. O-rings 37 which were seated in the grooves 26, 28 of the cap 20 prior to its insertion into the tube 12, confine the adhesive 32 to the recess 30. The fuse 10 is later baked at about 125° C (Celsius) for about 2 hours, during which time the adhesive sets.

The high pressure used for the injection of the adhesive 32 greatly improves the wetting of the surfaces by the adhesive 32, and, therefore, results in an exceptionally strong bond which can maintain its integrity dispite substantial differences in coefficient of thermal expansion of the cap 20 and tube 12 under thermal cycling conditions such as are present inside a transformer. It has been found that the wetting of the surface inside the recess 30 by the adhesive 32 is further improved if the surfaces are cleaned and abraded, such as by sanblasting, shortly before the cap 20 and tube 12 are assembled together.

Figure 3:
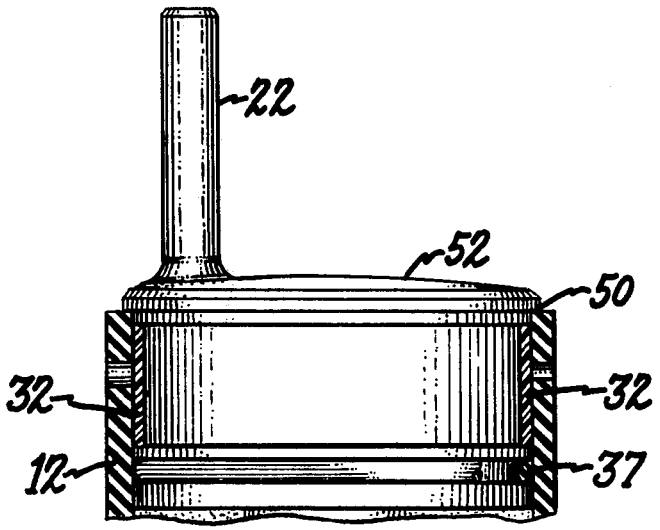
FIG. 3 is a partially sectioned elevation view of an alternative embodiment of certain features of the fuse of FIG. 1.

An alternative to the outer O-ring groove 26 of the end cap 20 is to provide a flange 50 about the shoulder of the cap 52 as shown in FIG. 3 of the drawings, which will abut the end wall face of the tube 12 and thereby confine the adhesive 32 during the injection process.

The particular adhesive used must be one which will maintain its bond strength during thermal cycling from −40° C (Celsius) to +140° C. It must be settable and in its unset form sufficiently plastic to be injected into the particular recess in question without the injection pressure causing rupturing of the members to be bonded.

While the present seal and method are particularly useful for current-limiting fuses, it should be apparent that their usefulness is not limited thereto, but is rather broad. What is involved generally is the defining of an annular confinement space between two telescoped members and the injection into that space of a settable adhesive. The space may be defined by one or more resilient gaskets or by rigid barriers such as annular raised flanges or like means for confining the adhesive to the space during injection. The space itself may be a recess in one or both members.

It should be understood that the necessity of the bleed aperture could conceivably be eliminated by evacuating the space between the members prior to the injecting of the adhesive.

I claim:

1. An electrical device comprising a cylindrical housing first member a cylindrical second member telescopingly fitted inside said housing member, at least one resilient gasket member between the inner surface of said first member and the outer surface of said second member, said gasket defining one end of an annular space between said first and second members, and a settable adhesive filling said granular space and rigidly bonding together said first and second members to form an annular hermetic seal.

2. The invention defined in claim 1 and wherein said first and second members are substantially circular cylinders.

3. The invention defined in claim 2 and wherein said first member is a circular electrical fuse housing tube and said second member is an end cap telescopingly fitted in one end of said first member and provided with two toroidal resilient gaskets for confining said adhesive to said annular space.

4. The invention defined in claim 2 and wherein said cap is provided with two annular gasket-receiving grooves and said gaskets are O-rings.

5. The invention defined in claim 4 and wherein said settable adhesive is a structural epoxy resin which is capable of maintaining its bond strength during thermal cycling of from minus about 40° C to about plus 140° C.

6. The invention defined in claim 1 and wherein said first member is a circular fuse housing tube and said second member is a circular end cap for said tube, said end cap having a rigid outer shoulder which forms a seal when adjacent the end of said housing tube and having an addition an inner seal formed by a toroidal resilient gasket between said inner and outer members.

* * * * *